US008366257B2

(12) United States Patent
Sasaki et al.

(10) Patent No.: US 8,366,257 B2
(45) Date of Patent: Feb. 5, 2013

(54) INKJET RECORDING APPARATUS

(75) Inventors: Tsutomu Sasaki, Ebina (JP); Shinta Moriya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 318 days.

(21) Appl. No.: 12/721,345

(22) Filed: Mar. 10, 2010

(65) Prior Publication Data

US 2010/0231622 A1 Sep. 16, 2010

(30) Foreign Application Priority Data

Mar. 10, 2009 (JP) ..... 2009-056092

(51) Int. Cl.
*B41J 2/18* (2006.01)
*B41J 2/195* (2006.01)
*B41J 2/175* (2006.01)

(52) U.S. Cl. ..... 347/89; 347/7; 347/85

(58) Field of Classification Search ..... None
See application file for complete search history.

(56) References Cited

U.S. PATENT DOCUMENTS 5,367,328 A * 11/1994 Erickson ..... 347/7
5,704,403 A * 1/1998 Schwenk et al. ..... 141/18
5,818,482 A 10/1998 Ohta et al.
5,847,736 A * 12/1998 Kanbayashi et al. ..... 347/89
6,050,680 A * 4/2000 Moriyama et al. ..... 347/85
6,234,615 B1 * 5/2001 Tsukuda ..... 347/85
6,945,640 B2 * 9/2005 Cheok ..... 347/85
8,128,212 B2 * 3/2012 Katada et al. ..... 347/89
8,132,903 B2 * 3/2012 Sakurai et al. ..... 347/92
2009/0315943 A1 12/2009 Ohnishi et al.

FOREIGN PATENT DOCUMENTS

JP 2898746 3/1999
JP 3269268 1/2002
JP 2003-341028 12/2003
JP 2004-50472 2/2004
JP 2005-125668 5/2005
JP 2006-68904 3/2006
JP 4155879 7/2008
JP 4298474 4/2009
JP 4337500 10/2009

* cited by examiner

*Primary Examiner* — Stephen Meier
*Assistant Examiner* — Leonard S Liang
(74) *Attorney, Agent, or Firm* — Cooper & Dunham LLP

(57) ABSTRACT

An inkjet recording apparatus includes a droplet ejection head, a head tank, a tube, an ink cartridge, and a liquid-feed pump. The droplet ejection head has a plurality of nozzles for ejecting ink. The head tank is mounted on the droplet ejection head, temporarily stores a certain amount of ink, and creates negative pressure in the droplet ejection head. The tube is connected to the head tank. The ink cartridge is connected via the tube to the head tank, the ink cartridge storing ink. The liquid-feed pump is disposed at the tube between the ink cartridge and the head tank to feed ink from the ink cartridge to the head tank through the tube. The liquid-feed pump is operable in reverse to feed ink from the head tank through the tube to the ink cartridge and create negative pressure in the head tank.

10 Claims, 10 Drawing Sheets

AIR RELEASED STATE

REFILL CERTAIN AMOUNT OF INK

SEALED STATE

EXPEL 0.6cc OF INK

LOST STATE OF NEGATIVE PRESSURE

LOWERING OF LIQUID LEVEL BY 0.6cc OF INK

INKJET RECORDING APPARATUS

CROSS-REFERENCE TO RELATED APPLICATIONS

The present patent application claims priority pursuant to 35 U.S.C. §119 from Japanese Patent Application No. 2009-056092, filed on Mar. 10, 2009 in the Japan Patent Office, which is incorporated herein by reference in its entirety.

BACKGROUND OF THE INVENTION

1. Field of the Invention

Illustrative embodiments of the present invention relate to an inkjet recording apparatus, and more specifically, to an inkjet recording apparatus capable of preventing negative pressure in a head tank from being completely lost during a standby time after ink ejection.

2. Description of the Background

Inkjet recording apparatuses generate energy using an energy generation unit, such as a piezoelectric element mounted on a liquid chamber of a recording head, to eject droplets of liquid, e.g., ink stored in the liquid chamber from ink nozzles provided in the head to form an image on a recording material. Inkjet recording apparatuses are widely used because of their cost-effectiveness and compact sizes. Below, one conventional type of inkjet recording apparatus is described with reference to drawings.

FIG. 12 is a schematic view illustrating a configuration of an ink-supply tube system in a conventional inkjet recording apparatus. As illustrated in FIG. 12, the conventional ink-supply tube system connects an ink cartridge 11 containing ink to a head tank 14 via a liquid-feed pump 12 and a supply tube 13 and employs in the recording head a single tube configuration for different colors of ink, e.g., black, cyan, magenta, and yellow. As ink stored in the head tank 14 is consumed for printing or maintenance, the liquid-feed pump 12 supplies (refills) ink from the ink cartridge 11 through the supply tube 13 to the head tank 14.

In such an inkjet recording apparatus, for example, the following maintenance operations are performed:

1. cleaning (optional/automatic) for restoring slightly clogged nozzles;
2. refreshing (optional) for restoring clogged nozzles not recovered by cleaning; and
3. air-releasing and refilling (automatic) for creating negative pressure in the head tank if the negatively pressurized state of the head tank is lost.

Cleaning and refreshing are performed to restore nozzles to optimum conditions, thus requiring a certain amount of ink to be discharged from the nozzles. By contrast, air-releasing and refilling operation is performed to create negative pressure in the head tank 14, that is, change the volume of the head tank 14, thus requiring no ink to be discharged from the nozzles.

FIG. 13 is a perspective view illustrating a configuration of the head tank 14 shown in FIG. 12. A negative-pressure lever 14-1 is mounted on the head tank 14 and moved by a film 14-2 that deforms as ink stored in the head tank 14 is consumed. The head tank 14 is negatively pressurized by a spring, not illustrated, which is provided in the head tank 14 to bias the film 14-2. Ink is supplied from an ink cartridge via an ink supply tube through a supply port 14-3. An air-release pin 14-4 is a pin with which the interior of the head tank is opened to the atmosphere when needed. At a lower portion of the head tank 14 is mounted a recording head 14-5 that ejects ink droplets. A detection unit 14-6 is provided to detect ink and air.

In creating negative pressure in the head tank 14, as illustrated in FIG. 14, ink is discharged from head nozzles 15 with a suction cap 21 covering the head nozzles 15. As a result, the internal volume of the head tank 14 changes, thus deforming the spring in the head tank 14. Ink discharged from the head nozzles 15 is suctioned by a suction pump 22 and received in a waste-liquid tank 23.

In such inkjet recording apparatuses, ink is typically supplied from an ink cartridge. However, in replacing the ink cartridges, air may be mixed into a new cartridge, thus causing ink ejection failure. To deal with such a problem, several conventional approaches have been proposed.

For example, in one technique like that described in Japanese Patent Application Laid-Open No. 2005-125667, a liquid ejection apparatus includes an ink supply line through which ink is supplied from the ink tank to the ink head and an ink return line through which ink is returned from the ink head to the ink tank. In the liquid ejection apparatus, ink circulates between the ink head and the ink tank to prevent leakage of ink from the nozzles of the ink head.

In such a conventional liquid ejection apparatus, resin materials may be used in ink passage portions of components, such as the ink cartridge, the liquid-feed pump, the liquid-feed tube, the head tank, and the ink head in the ink-supply tube system. Further, joint portions between such components are formed of, e.g., rubber packing material to obtain high sealing performance.

When the liquid ejection apparatus is in a standby state, the interior of the head tank is negatively pressurized. As long as such a standby state is maintained for a time period that remains within design limits, it does not matter. However, if the standby time exceeds design limits, the negative pressure of the head tank is lost and the interior of the head tank acquires atmospheric pressure. Such loss of negative pressure may be caused by the air permeability of the resin or rubber material and the sealing performance of the rubber packing material. Further, since the interior of the supply tube is negatively pressurized by the head tank, air may be absorbed into the supply tube and as a result the negative pressure of the head tank is lost.

To reduce the air permeability of the materials, for example, it is conceivable to substitute for such resin and rubber materials higher-performance resin and rubber materials or metal materials, or coat the surfaces of components with metal material. To enhance the sealing performance of packing material, it is conceivable to connect joint portions by adhesion, deposition, or fusion, or integrate some components so as to reduce the number of joints.

A further consideration is that, in an inkjet recording apparatus with an ink cartridge containing a great amount of ink, the ink cartridge may be directly mounted on the recording head that is mounted on a carriage. In such a configuration, the weight of the ink cartridge may cause failures in the operation of the carriage, degrading image quality. Hence, in one conventional inkjet recording apparatus, the ink cartridge is mounted on a housing of the inkjet recording apparatus and as illustrated in FIG. 14 a head tank 14 that temporarily stores ink is mounted on the recording head that is mounted on the carriage. In such an inkjet recording apparatus, if ink is fed from the ink cartridge with the ink cartridge out of ink, the negative pressure in the liquid feed passage between the ink cartridge and the head tank increases and air bubbles may get into the liquid feed passage upon installation or removal of the ink cartridge. Such air bubbles may further get into the head tank through the liquid feed passage. At this time, for example, if ink is supplied with the air release valve opened, a combination of air bubbles and ink may leak from the air release valve, causing failures such as damage to the recording head. Further, if such air bubbles get into the nozzles of the recording head, image failures such as non-ejection from a portion of the nozzles may arise.

Hence, to deal with such failures, several conventional approaches have been proposed. In one conventional technique like that described in Japanese Patent Application Laid-open No. 2003-341028, an inkjet printer includes an intermediate ink tank between the ink cartridge and the recording head and a pressure sensor disposed away from the intermediate ink tank. While detecting a negatively pressurized state of the recording head, the intermediate ink tank is elevated up and down to keep a certain negative pressure.

However, a drawback of such an arrangement is that, as the recording head, the intermediate ink tank, and the pressure sensor are disposed away from each other, the system may be complicated and upsized. Further, the system includes such a mechanism of elevating the ink tank to keep a certain negative pressure, thus resulting in upsizing and complicated configuration. Further, if air bubbles get into the intermediate ink tank during replacement of the ink cartridges, it is difficult to remove such air bubbles.

In another technique like that described in Japanese Patent No. 3,269,368, an ink supply device is proposed in which a sub tank having a meniscus formation member is provided with a main tank containing ink. As the pressure in the main tank decreases with ink consumption, ink is automatically supplied from the sub tank by an amount corresponding to the decreased pressure to maintain a certain negative pressure. However, as the meniscus formation member deteriorates, it may be difficult to keep the certain negative pressure. Further, if air bubbles get into the sub tank in replacing ink cartridges, it may be difficult to remove such air bubbles from the sub tank.

In still another conventional technique like that described in Japanese Patent No. 2,898,746, an inkjet pen includes a sealed ink tank containing ink. In the sealed tank, a small hole is formed so that one end of the hole is open to the atmosphere. As ink stored in the ink tank is consumed, air is supplied through the hole into the ink tank to keep a certain negative pressure in the ink tank. However, since the ink tank is always open to the air, air bubbles are more likely to go into the ink tank. Further, if such air bubbles get into a head channel in replacing ink cartridges, it may be difficult to remove such air bubbles from the head channel.

SUMMARY OF THE INVENTION

In an illustrative embodiment, an inkjet recording apparatus includes a droplet ejection head, a head tank, a tube, an ink cartridge, and a liquid-feed pump. The droplet ejection head has a plurality of nozzles for ejecting ink. The head tank is mounted on the droplet ejection head, temporarily stores a certain amount of ink, and creates negative pressure in the droplet ejection head. The tube is connected to the head tank. The ink cartridge is connected via the tube to the head tank, the ink cartridge storing ink. The liquid-feed pump is disposed at the tube between the ink cartridge and the head tank to feed ink from the ink cartridge to the head tank through the tube. The liquid-feed pump is operable in reverse to feed ink from the head tank through the tube to the ink cartridge and create negative pressure in the head tank.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
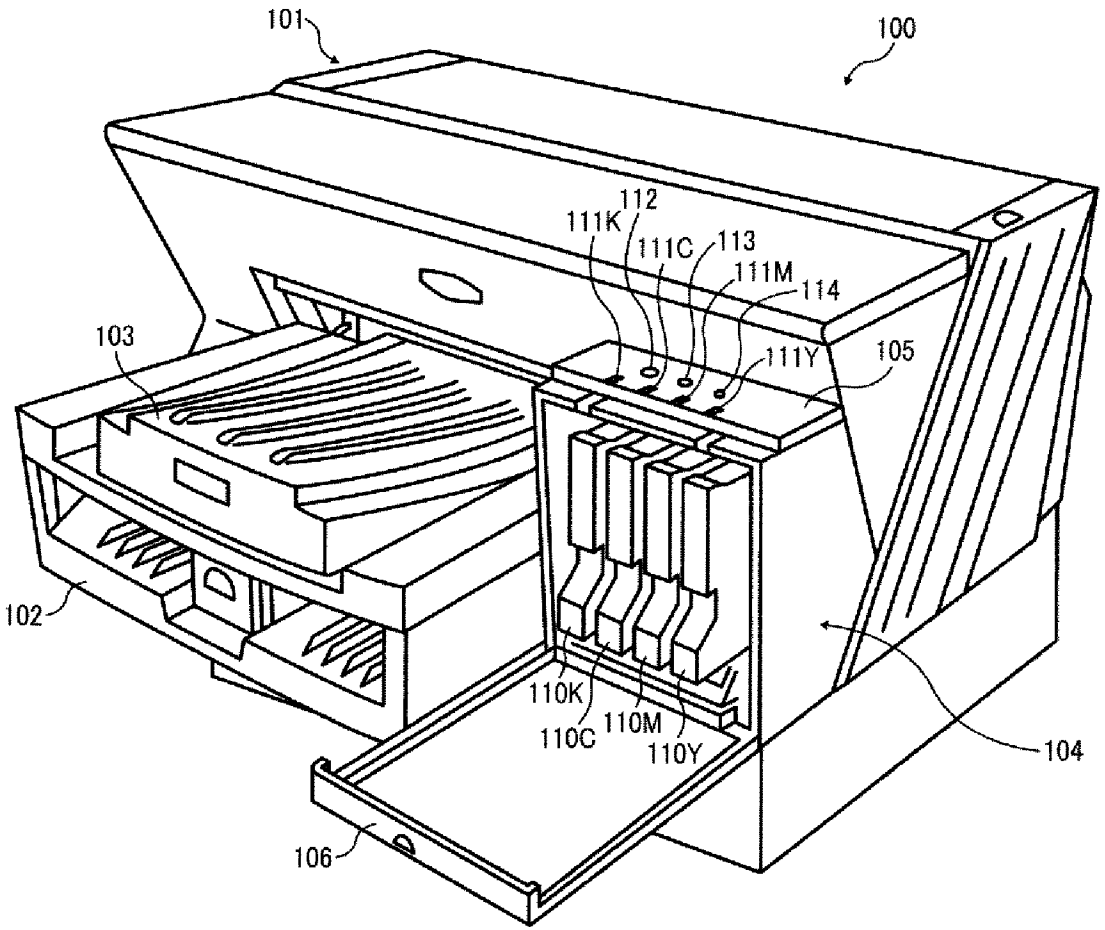
FIG. 1 is a front perspective view illustrating an inkjet recording apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

FIG. 1 is a front perspective view illustrating an inkjet recording apparatus 100 according to an illustrative embodiment of the present disclosure. The inkjet recording apparatus 100 includes a housing 101, a sheet feed tray 102 that is mounted in the housing 101 to store sheets, and a sheet output tray 103 that is detachably mounted in the housing 101 to stack sheets on which images are recorded (formed). At one end portion of the front side of the housing 101 (i.e., a lateral side of a tray section including the sheet feed tray 102 and the sheet output tray 103) is disposed a cartridge mount portion 104 that protrudes forward from the front face of the housing 101 and is positioned lower than the top face of the housing 101. On the top face of the cartridge mount portion 104 is mounted an operation-and-display unit 105 including operation buttons and indicators described below.

Ink cartridges 110K, 110C, 110M, and 110Y (hereinafter collectively referred to as "ink cartridges 110" unless colors are distinguished) are detachably inserted to the cartridge mount portion 104 from the front side toward the rear side of the housing 101. The ink cartridges 110K, 110C, 110M, and 110Y are recording-liquid containers that contain a plurality of different color materials (recording liquids or inks), e.g., black (K), cyan (C), magenta (M), and yellow (Y) inks. At the front side of the cartridge mount portion 104 is openably/closably mounted a front cover (cartridge cover) 106 that opens when the ink cartridges 110 are detached from the cartridge mount portion 104. In FIG. 1, the ink cartridges 110K, 110C, 110M, and 110Y are mounted standing side by side in the cartridge mount portion 104.

The operation-and-display unit 105 includes remaining-quantity indicators 111K, 111C, 111M, and 111Y indicating that the remaining quantities of the respective color inks in the ink cartridges 110K, 110C, 110M, and 110Y are at end state or near-end state. On operation-and-display unit 105, the remaining-quantity indicators 111K, 111C, 111M, and 111Y are disposed at positions corresponding to the mount positions of the ink cartridges 110K, 110C, 110M, and 110Y. Further, a power button 112, a sheet-feed/print-restart button 113, and a cancel button 114 are disposed on the operation-and-display unit 105.

Figure 2:
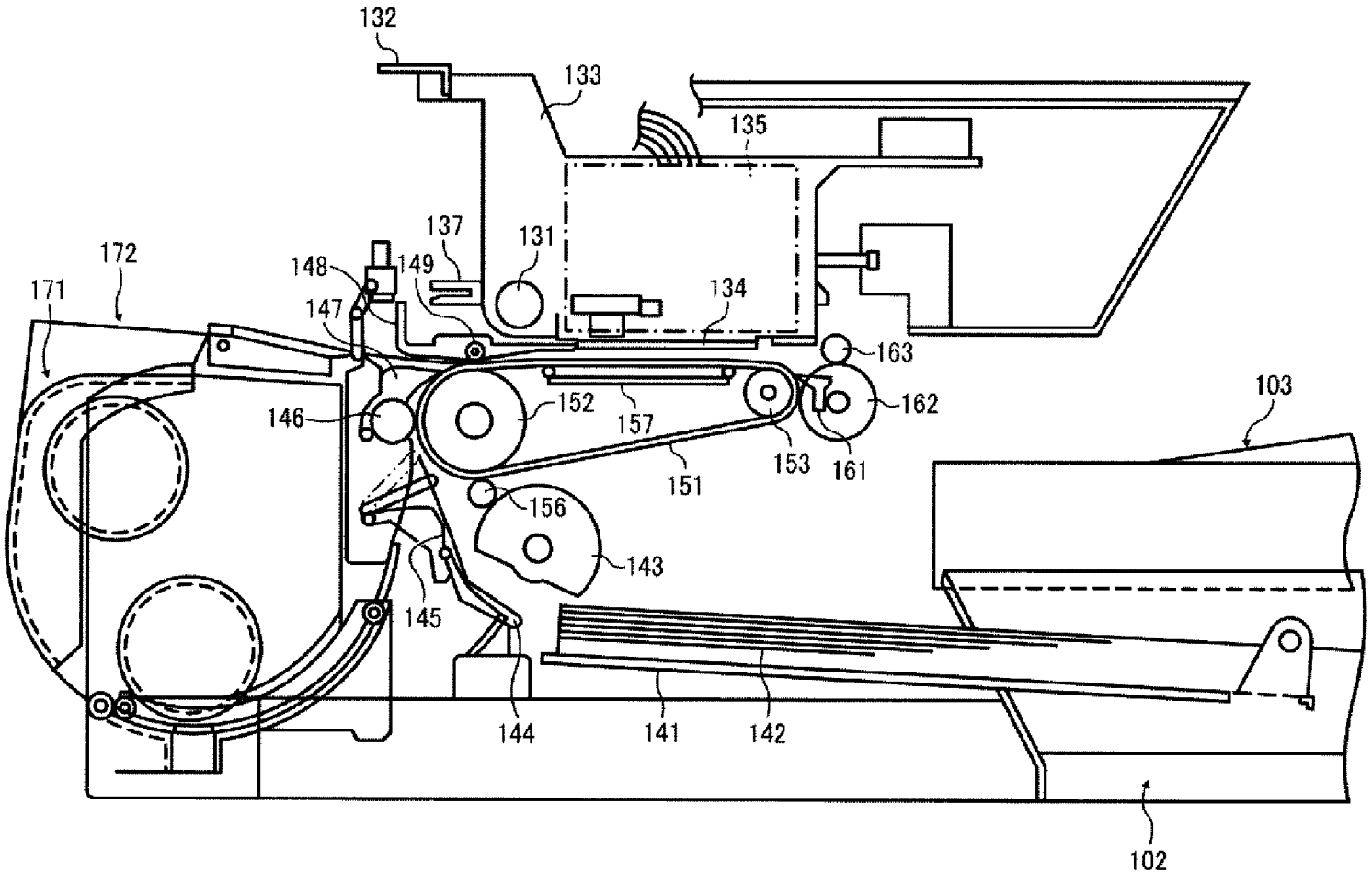
FIG. 2 is a schematic side view illustrating a mechanical section of the inkjet recording apparatus illustrated in FIG. 1.
Figure 3:
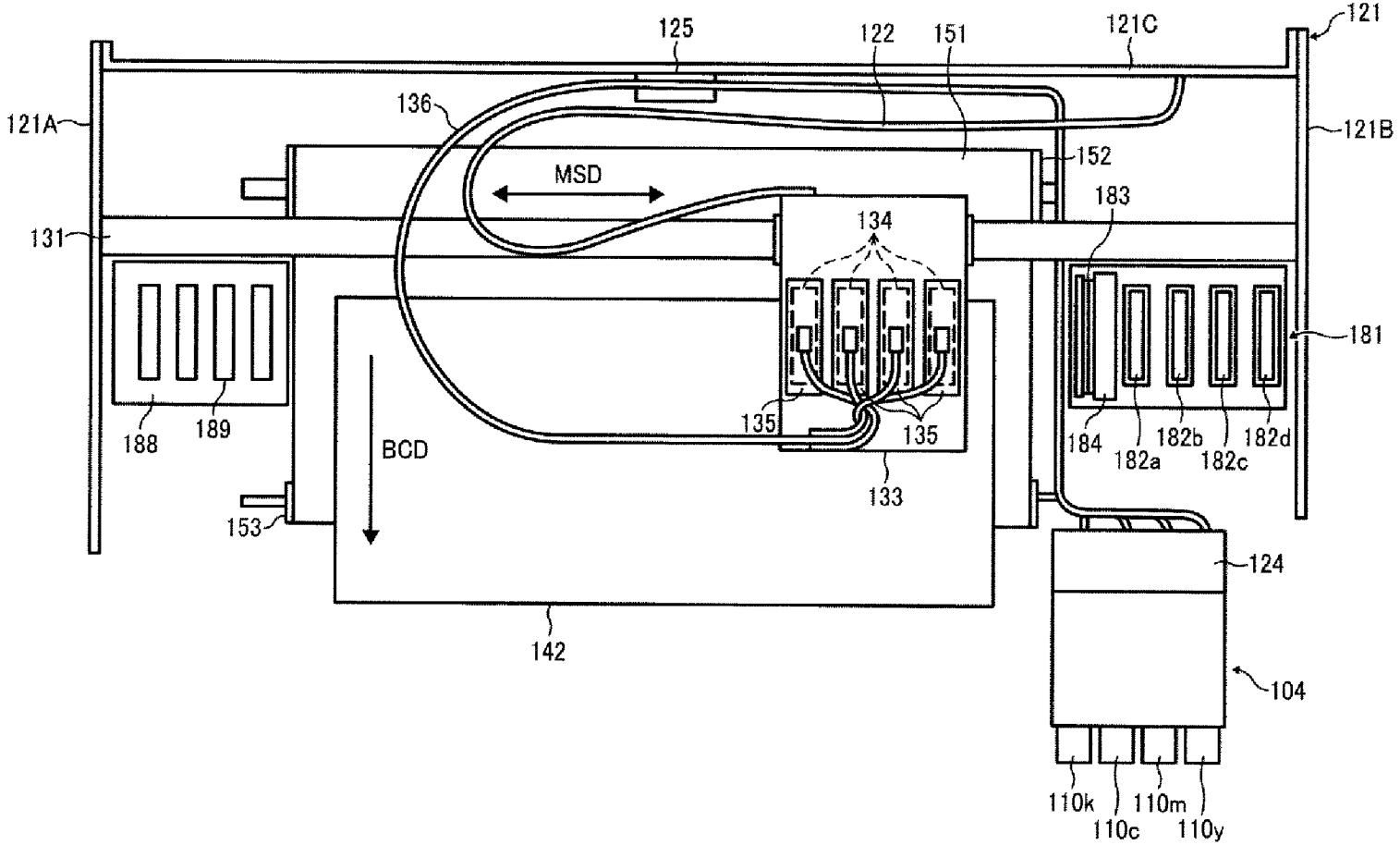
FIG. 3 is a partial plan view illustrating the mechanical section illustrated in FIG. 2.

Next, a mechanical section of the inkjet recording apparatus 100 is described with reference to FIGS. 2 and 3. FIG. 2 is a schematic side view illustrating the inkjet recording apparatus 100. FIG. 3 is a partial plan view illustrating the inkjet recording apparatus 100.

In the mechanical section of the inkjet recording apparatus 100, a carriage 133 is held with a guide rod 131 and a stay 132 so as to slide in a main scan direction MSD indicated by a double arrow illustrated in FIG. 3. The guide rod 131 and the stay 132 serving as guide members are extended between side plates 121A and 121B constituting a frame 121. The carriage 133 is moved by a main scan motor, not illustrated, for scanning in the main scan direction MSD.

On the carriage 133 are mounted recording heads 134 that are four droplet ejection heads to eject droplets of the different color inks of Y, C, M, and K. The recording heads 134 are mounted on the carriage 133 so that a plurality of ejection ports is arranged in a direction perpendicular to the main scan direction and ink droplets are ejected downward from the ejection ports.

As a pressure generator that generates pressure to eject droplets, the droplet ejection heads constituting the recording heads 134 may employ, for example, a piezoelectric actuator such as a piezoelectric element, a thermal actuator that generates film boiling of liquid (ink) using an electro/thermal converting element such as a heat-generation resistant to cause a phase change, a shape-memory-alloy actuator that changes metal phase by a temperature change, or an electrostatic actuator that generates pressure by electrostatic force.

On the recording heads 134 are mounted driver ICs (integrated circuits) connected to a controller via a harness (flexible print cable) 122. On the carriage 133 is mounted a S plurality of head tanks 135 that supplies the different color inks to the recording heads 134. The different color inks are supplied (refilled) from the ink cartridges 110K, 110C, 110M, and 110Y mounted in the cartridge mount portion 104 to the head tanks 135 via ink supply tubes 136. In the cartridge mount portion 104 is mounted a supply-pump unit 124 that feeds ink from the ink cartridges 110. The ink supply tubes 136 are held with a stopper 125 on a rear plate 121C that forms a portion of the frame 121.

A sheet feed section that feeds sheets 142 stacked on a sheet stack portion (platen) 141 of the sheet feed tray 102. The sheet feed section further includes a sheet feed roller 143 that separates the sheets 142 from the sheet stack portion 141 and feeds the sheets 142 sheet by sheet and a separation pad 144 that is disposed facing the sheet feed roller 143. The separation pad 144 is made of a material of a high friction coefficient and biased toward the sheet feed roller 143.

To feed the sheets 142 from the sheet feed section to a position below the recording heads 134, the inkjet recording apparatus 100 includes a first guide member 145 that guides the sheet 142, a counter roller 146, a conveyance guide member 147, a press member 148 including a front-end press roller 149, and a conveyance belt 151 that conveys the sheet 142 to a position opposing the recording heads 134 with the sheet 142 electrostatically attracted thereon.

The conveyance belt 151 is an endless belt that is looped between a conveyance roller 152 and a tension roller 153 so as to circulate in a belt conveyance direction (sub-scan direction). A charge roller 156 is provided to charge the surface of the conveyance belt 151. The charge roller 156 is disposed so as to contact the surface of the conveyance belt 151 and rotate depending on the circulation of the conveyance belt 151. On the back side of the conveyance belt 151 is disposed a second guide member 157 at a position corresponding to a print area of the recording heads 134.

The conveyance roller 152 is rotated by a sub-scan motor, not illustrated, via a timing roller, so that the conveyance belt 151 circulates in the belt conveyance direction "BCD" illustrated in FIG. 3.

The inkjet recording apparatus 100 further includes a sheet output section that outputs the sheet 142 on which an image has been formed by the recording heads 134. The sheet output section includes a separation claw 161 that separates the sheet 142 from the conveyance belt 151, a first output roller 162, a second output roller 163, and a sheet output tray 103 disposed below the first output roller 162.

A duplex unit 171 is detachably mounted on a rear portion of the housing 101. When the conveyance belt 151 rotates in the reverse direction to return the sheet 142, the duplex unit 171 receives the sheet 142. Then the duplex unit 171 turns the sheet 142 upside down to feed the sheet 142 between the counter roller 146 and the conveyance belt 151. At the top face of the duplex unit 171 is formed a manual-feed tray 172.

As illustrated in FIG. 3, a maintenance-and-recovery unit 181 is disposed at a non-print area that is located on one end in the main-scan direction of the carriage 133. The maintenance-and-recovery unit 181 maintains and recovers nozzle conditions of the recording heads 134.

The maintenance-and-recovery unit 181 includes caps 182*a* to 182*d* (hereinafter collectively referred to as "caps 182" unless distinguished) that cover the nozzle faces of the recording heads 134, a wiper blade 183 that is a blade member to wipe the nozzle faces of the recording heads 134, and a first droplet receiver 184 that receives ink droplets discharged to remove increased-viscosity ink during maintenance ejection. For example, the cap 182*a* may be used for ink suction and moisture retention while the other caps 182*b* to 182*d* for moisture retention.

Waste liquid (e.g., increased-viscosity ink) expelled in maintenance-and-recovery operation of the maintenance-and-recovery unit 181, ink discharged to the caps 182, ink adhered to the wiper blade 183, ink wiped with a wiper cleaner 185, and ink discharged to the first droplet receiver 184 are kept in a waste tank, not illustrated.

As illustrated in FIG. 3, a second droplet receiver 188 is disposed at a non-print area on the other end in the main-scan direction of the carriage 133. The second droplet receiver 188 receives ink droplets that are discharged to remove increased-viscosity ink in recording (image forming) operation and so forth. The second droplet receiver 188 has openings 189 arranged in parallel with the rows of nozzles of the recording heads 134.

In the inkjet recording apparatus 100 having the above-described configuration, the sheet 142 is separated sheet by sheet from the sheet feed tray 102, fed in a substantially vertically upward direction, guided along the first guide member 145, and conveyed between the conveyance belt 151 and the counter roller 146. Further, the front tip of the sheet 142 is guided with a conveyance guide 137 and pressed against the conveyance belt 151 by the front-end press roller 149 to turn the traveling direction of the sheet 142 by substantially 90°.

At this time, an AC (alternating current) bias supply unit alternately supplies positive and negative voltages to the charge roller 156 so that the conveyance belt 151 is charged with an alternating voltage pattern, that is, an alternating band pattern of positively-charged areas and negatively-charged areas. When the sheet 142 is fed onto the conveyance belt 151 alternatively charged with positive and negative charges, the sheet 142 is attracted on the conveyance belt 151 and conveyed in the sub scanning direction by circulation of the conveyance belt 151.

By driving the recording heads 134 in response to image signals while moving the carriage 133 in the main scan direction in accordance with information on the position of the carriage 133 detected with a linear encoder 137, ink droplets are ejected onto the sheet 142, which is stopped below the recording heads 134, to form one band of a desired image. Then, the sheet 142 is fed by a certain distance to prepare for the next operation to record another band of the image. Receiving a signal indicating that the image has been recorded or the rear end of the sheet 142 has arrived at the recording area, the recording heads 134 finish the recording operation and the sheet 142 is outputted to the sheet output tray 103.

In waiting for the next recording (printing) operation, the carriage 133 moves to the maintenance-and-recovery unit 181 and the caps 182 cover the recording heads 134. Thus, the moisture of the nozzles is kept to prevent an ejection failure due to ink drying. Then, a suction pump, not illustrated, suctions ink from the nozzles with the recording heads 134 covered with the caps 182, which is called "nozzle suction" or "head suction". Thus, the recovery operation is performed to remove increased-viscosity ink (recording liquid) or air bubbles. Further, before or during a recording operation, the above-described maintenance ejection is performed to discharge ink for maintenance that is not used to form an image on the sheet. Such maintenance ejection allows keeping a stable ejection performance of the recording heads 134.

Figure 4:
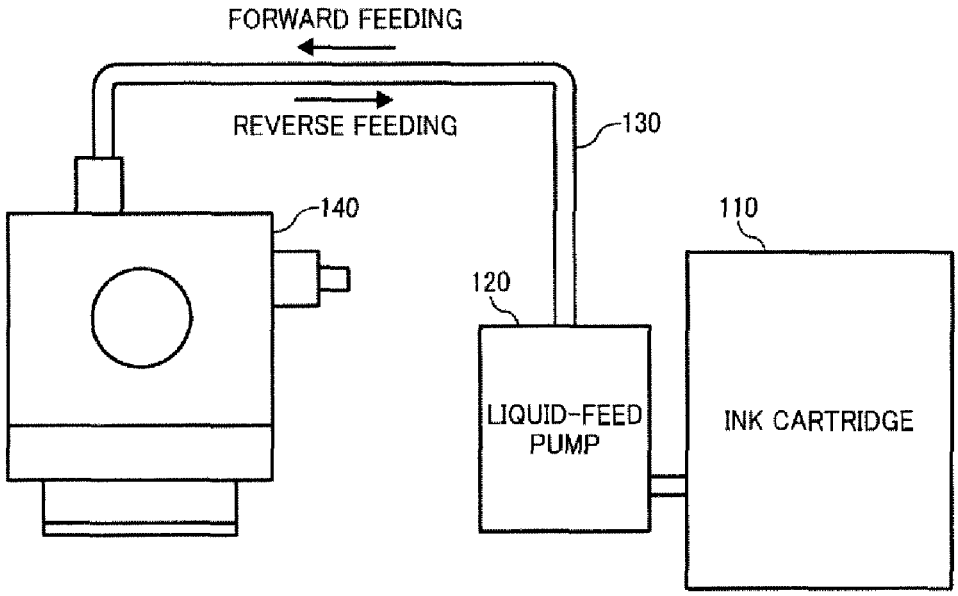
FIG. 4 is a schematic view illustrating a configuration of an ink supply tube system in an inkjet recording apparatus according to an illustrative embodiment.

FIG. 4 is a schematic view illustrating a configuration of an ink supply tube system used in an inkjet recording apparatus 100 according to an illustrative embodiment. As illustrated in FIG. 4, the inkjet recording apparatus 100 according to the present illustrative embodiment returns (flows back) ink, which is stored in a head tank 140, to an ink cartridge 110 instead of ejecting ink from the nozzle face of the recording head. Such a configuration allows recycling of ink used in creating negative pressure, thus reducing waste of ink.

Next, liquid feeding conditions in the present illustrative embodiment are described below.

As described above, if an inkjet recording apparatus is left unused for a long period, a large amount of air bubbles might occur in a tube system of the inkjet recording apparatus. If a mixture of ink and air in the tube system directly flows back from a head tank to an ink cartridge, air may accumulate in the ink cartridge. In such a state, if ink is supplied to the head tank, the air accumulated in the ink cartridge may generate bubbles in the head tank, thus causing failures. Hence, in the inkjet recording apparatus 100 according to the present illustrative embodiment, as one liquid feeding condition for creating negative pressure, ink is fed from the ink cartridge 110 to the head tank 140 (forward feeding) and then fed from the head tank 140 to the ink cartridge 110 (reverse feeding), thereby creating negative pressure. The liquid-feed amount of the forward feeding is set equal to or greater than the liquid-feed amount of the reverse feeding.

Figure 5:
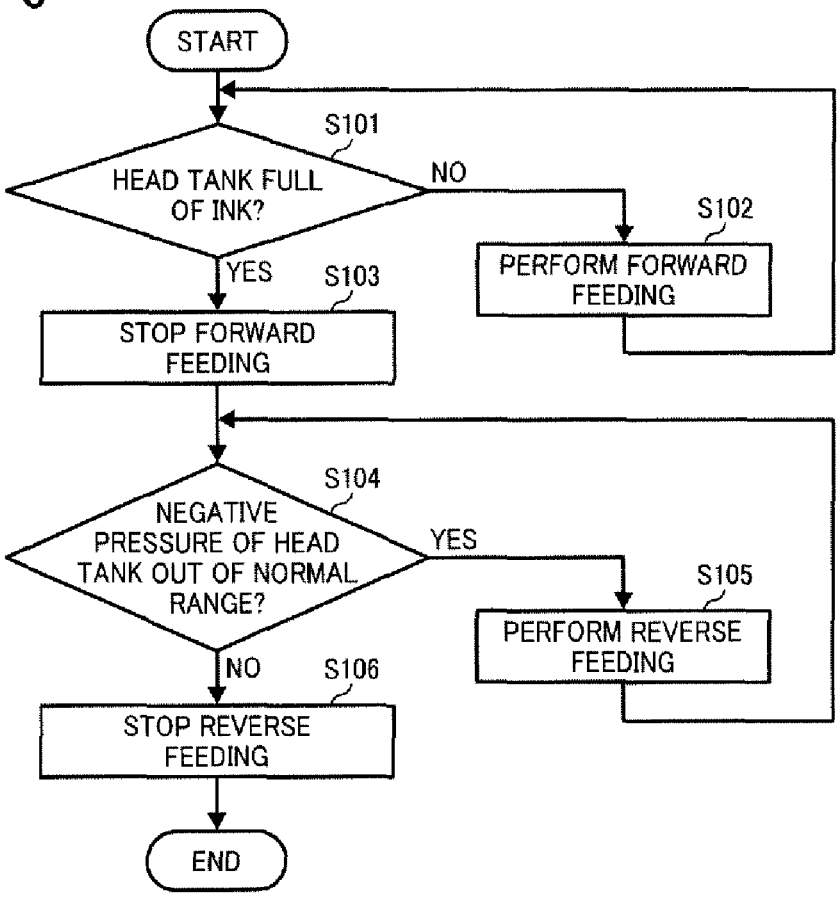
FIG. 5 is a flowchart illustrating a liquid-feed process of a liquid-feed pump.

Next, operation of a liquid-feed pump 120 in the inkjet recording apparatus 100 according to the present illustrative embodiment is described with reference to a flowchart illustrated in FIG. 5.

At S101, for the remaining amount of ink in the head tank 140, a liquid-amount detector with electrode pins or fillers, not illustrated, detects whether or not the head tank 140 is full of ink. If the head tank 140 is not full of ink ("NO" at S101), at S102 the liquid-feed pump 120 performs forward feeding to supply ink to the head tank 140. If the head tank 140 is full of ink ("YES" at S101), at S103 the liquid-feed pump 120 stops forward feeding. At S104, a pressure detector, not illustrated, detects whether or not the negative pressure of the head tank 140 is out of normal range. If the negative pressure of the head tank 140 is out of normal range ("YES" at S104), at S105 the liquid-feed pump 120 performs reverse feeding to re-create negative pressure. If the negative pressure of the head tank 140 is within (or is restored to) normal range ("NO" at S104), at S106 the liquid-feed pump 120 performs reverse feeding to re-create negative pressure.

Figure 6:
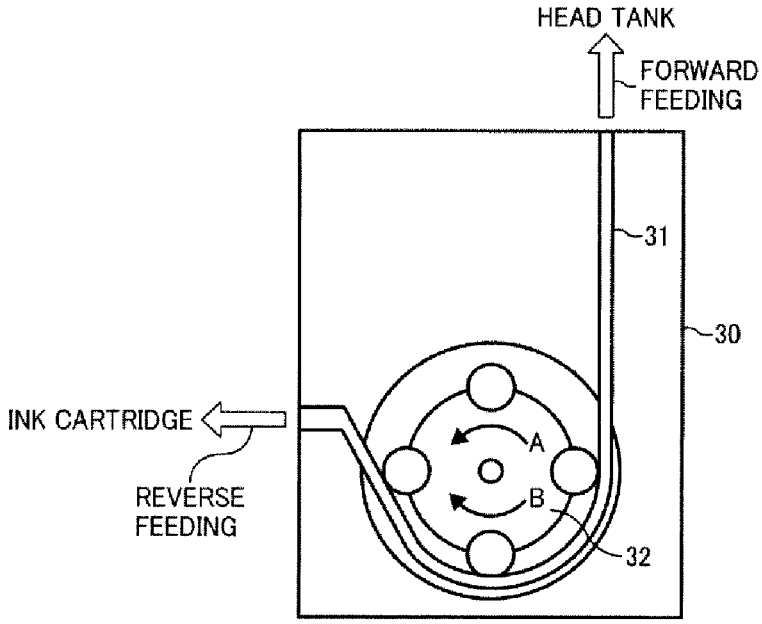
FIG. 6 is a schematic plan view illustrating a configuration of a tube pump.

The liquid-feed pump 120 may be, e.g., a tube pump 30 illustrated in FIG. 6 having a simple pump structure that switches forward feeding and reverse feeding by changing the rotation direction of a driving motor. In FIG. 6, a rubber tube 31 for liquid feeding is wound in the tube pump 30 and partially pressed by a pump rotor 32 in the tube pump 30. By rotating the pump rotor 32, such a pressed point of the rubber tube 31 moves in the rotation direction of the pump rotor 32 to feed ink in the rotation direction of the pump rotor 32. Specifically, when ink is fed from the ink cartridge 110 to the head tank 140 by forward feeding, the pump rotor 32 rotates in a direction indicated by an arrow "A" illustrated in FIG. 6. By contrast, when ink is fed from the head tank 140 to the ink cartridge 110 by reverse feeding, the pump rotor 32 rotates in a direction indicated by an arrow "B" illustrated in FIG. 6. In this regard, the rotation of the pump rotor 32 in the direction indicated by the arrow "A" is referred to as "forward rotation", and the rotation of the pump rotor 32 in the direction indicated by the arrow "B" is referred to as "reverse rotation". As described above, in the present illustrative embodiment, controlling the forward and reverse rotation of the pump rotor 32 allows controlling the feed direction of ink. Further, using the tube pump 30 of the simple structure as the liquid-feed pump 120 allows space saving. Further, controlling the feed direction of ink by the forward and reverse rotation of the pump rotor 32 allows a simple configuration of the tube system. In this regard, it is to be noted that the structure of the tube pump 30 may be an eccentric cam type instead of a rotation roller type illustrated in FIG. 6.

Figure 7A:
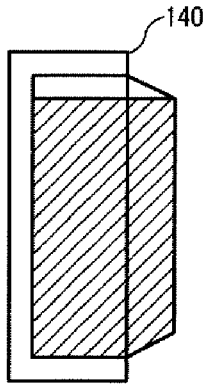
FIGS. 7A to 7C are schematic cross-section views illustrating an example of loss of negative pressure in an ink tank.
Figure 7B:
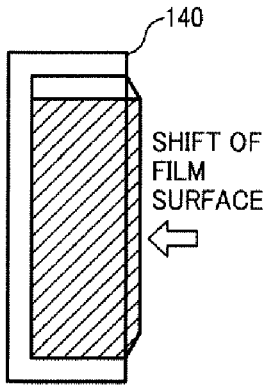
Figure 7C:
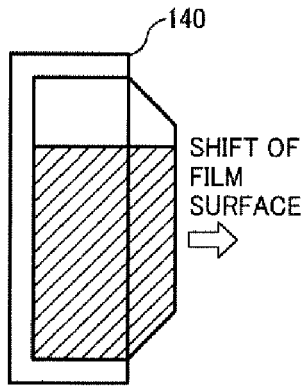

As illustrated in FIG. 7A, when creating negative pressure, with the head tank 140 opened to the atmosphere via an air release valve, ink is supplied to the head tank 140 until ink in the head tank 140 reaches a predetermined amount. Then, as illustrated in FIG. 7B, with the air release valve closed, a certain amount of ink of e.g., 0.6 cc is suctioned from the head tank 140. Thus, a diaphragm mounted on one side of the head tank 140 is deformed and negative pressure is generated by the repulsive force of a coil spring connected to the diaphragm. Accordingly, if the negative pressure of the head tank 140 is lost after a long unused period, as illustrated in FIG. 7C, the level of ink goes down by a height corresponding to the ink amount of 0.6 cc. Hence, to create negative pressure, more than 0.6 cc of ink should be supplied to the head tank 140 before suctioning ink from the head tank 140. Thus, the liquid feeding condition of the present illustrative embodiment can be employed without changing the structure of the head tank 140.

In an inkjet recording apparatus including a head tank that temporarily stores recording liquid, e.g., ink supplied from an ink cartridge, if recording liquid is supplied into the head tank with the ink cartridge out of ink, a strong negative pressure may occur at a connecting portion between the ink cartridge and a liquid-feed pump. At this state, if the ink cartridge is removed from the inkjet recording apparatus, air bubbles may get into a supply passage of the liquid-feed pump and then into the head tank by a subsequent supply operation. If air bubbles excessively get into the head tank, for example, in the head tank including an opening unit such as the air release valve for opening the interior of the head tank to the atmosphere, ink as well as air bubbles might leak from the opening unit, causing a failure in the recording head or mixing of air bubbles in the head tank. Further, such air bubbles might get into liquid chambers in the head tank, causing failures such as non-ejection from a portion of the nozzles or negative-pressure control error.

Hence, upon replacement of the ink cartridges, liquid feeding is controlled in accordance with, e.g., a control process illustrated in FIGS. 8 to 11. Such control prevents air bubbles from getting into the ink supply passage, thus preventing failures such as non-ejection from a portion of nozzles, and damage of the recording head. The liquid-feeding control upon replacement of the ink cartridges is described below with reference to FIGS. 8 to 11.

Figure 8:
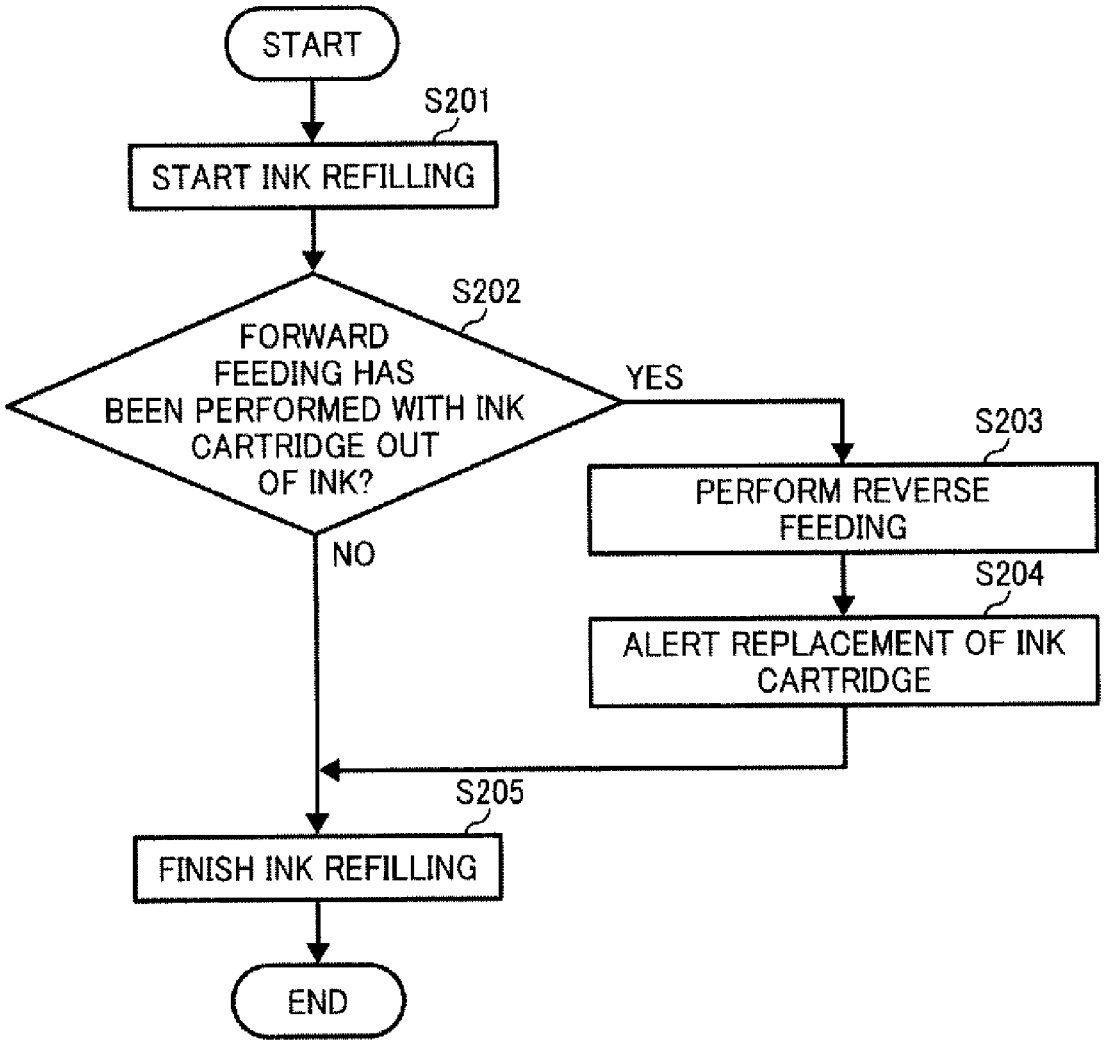
FIG. 8 is a flowchart illustrating a control process of liquid feeding performed in replacing ink cartridges.

FIG. 8 is a flowchart illustrating a control process of liquid feeding performed upon replacement of the ink cartridges. In FIG. 8, during execution of an ink supply operation for refilling ink to the head tank (S201), if the liquid-feed pump performs forward feeding with the ink cartridge out of ink ("YES" at S202), at S203 the liquid-feed pump performs reverse feeding. At S204, replacement of the ink cartridges is alerted to a user. At S205, the refilling of ink to the head tank is finished.

Figure 9:
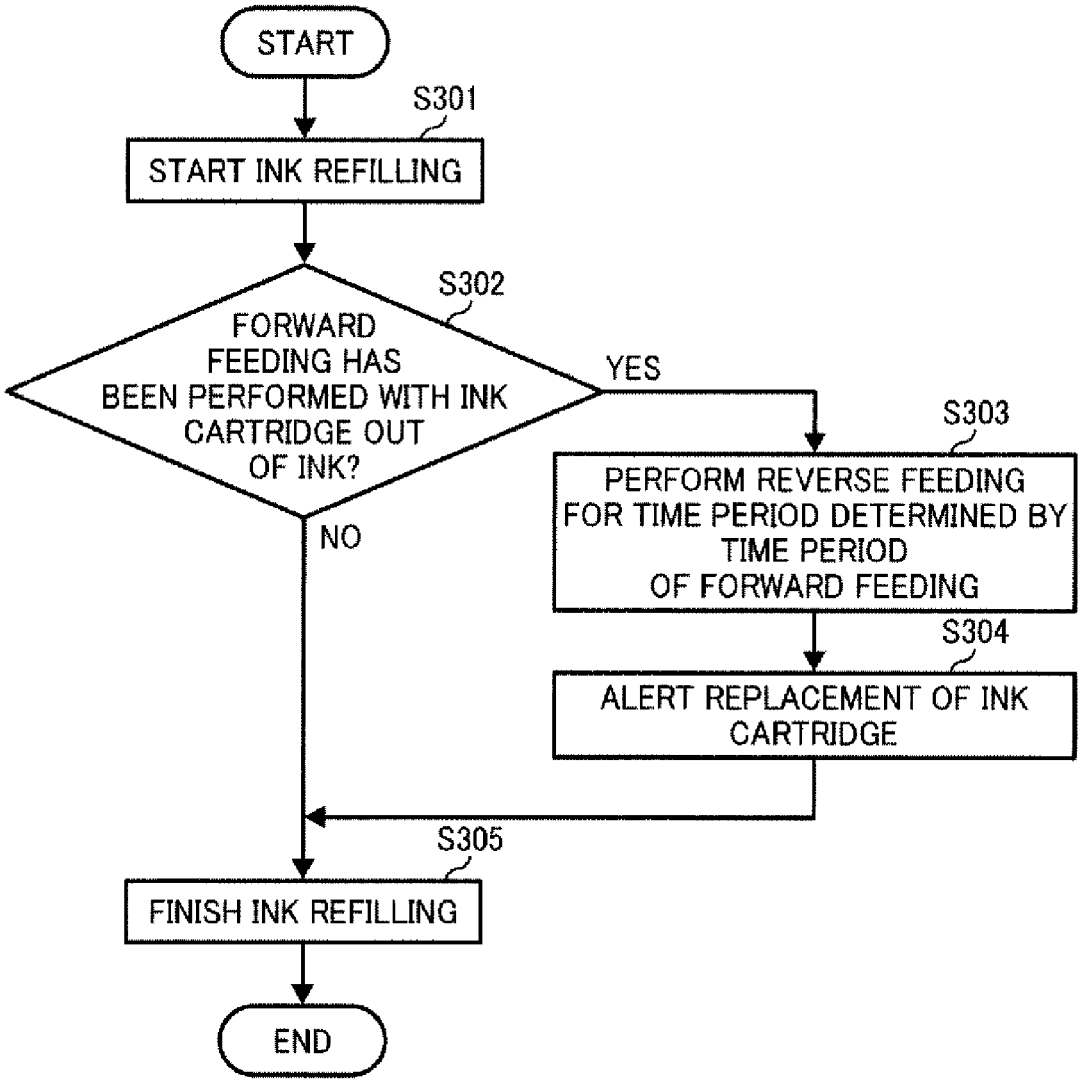
FIG. 9 is a flowchart illustrating another control process of liquid feeding in replacing ink cartridges.

FIG. 9 is a flowchart illustrating another control process of liquid feeding upon replacement of the ink cartridges. In FIG. 9, during execution of an ink supply operation for refilling ink to the head tank (S301), if the liquid-feed pump performs forward feeding with the ink cartridge out of ink ("YES" at S302), at S303 the liquid-feed pump performs reverse feeding for a time period determined by a time period for which the liquid-feed pump has been performed the forward feeding. At S304, replacement of the ink cartridges is alerted to a user. At S305, the refilling of ink to the head tank is finished.

Figure 10:
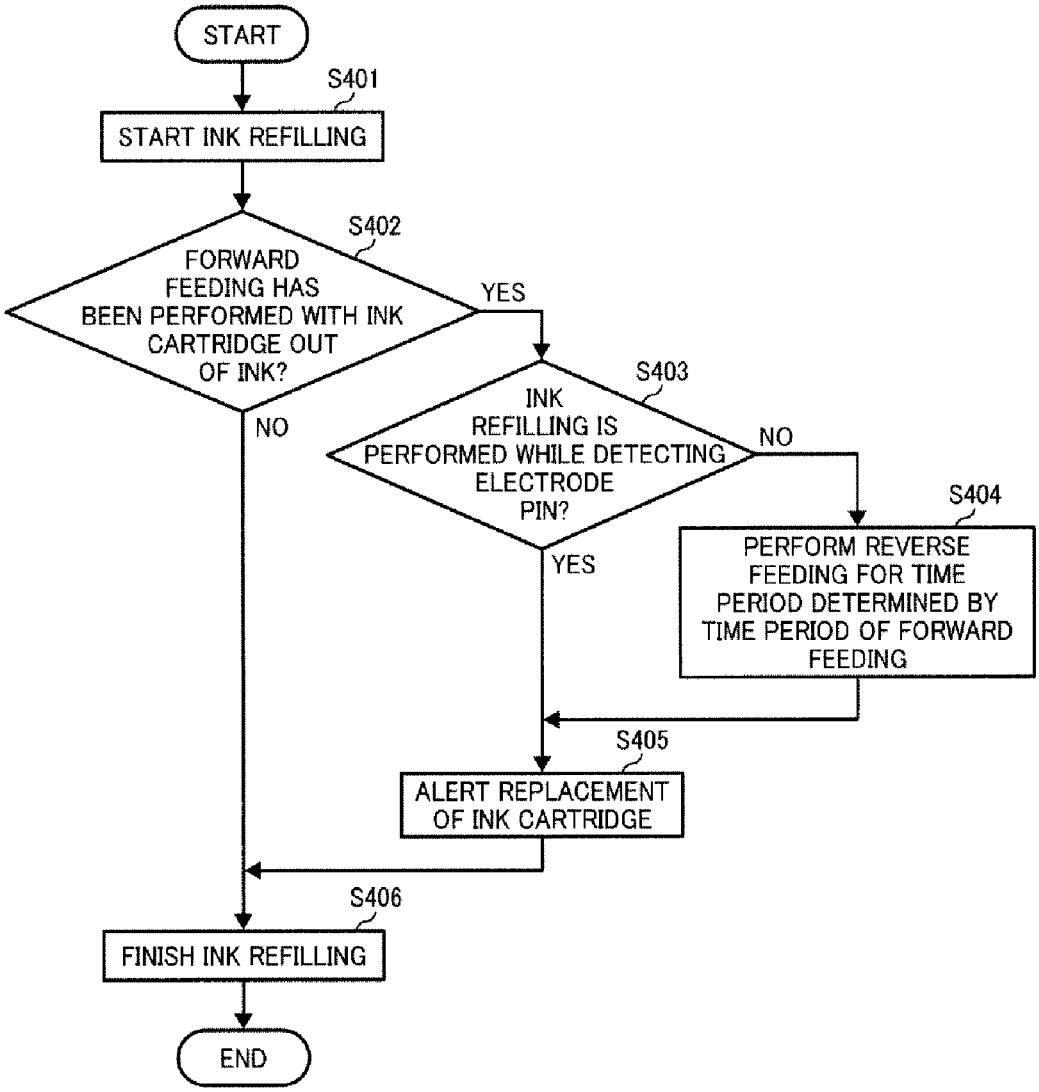
FIG. 10 is a flowchart illustrating still another control process of liquid feeding in replacing ink cartridges.

FIG. 10 is a flowchart illustrating still another control process of liquid feeding upon replacement of the ink cartridges. In FIG. 10, during execution of an ink supply operation for refilling ink to the head tank (S401), if the liquid-feed pump performs forward feeding with the ink cartridge out of ink ("YES" at 5402) and ink is supplied while detecting output voltages applied between electrode pins mounted on the head tank ("YES" at S403), at S405 replacement of the ink cartridges is alerted to a user without performing reverse feeding of the liquid-feed pump. By contrast, if ink is supplied without detecting output voltages applied between electrode pins mounted on the head tank ("NO" at S403), at S404 the liquid-feed pump performs reverse feeding for a time period determined by a time period for which the liquid-feed pump has been performed the forward feeding. At 5405, replacement of the ink cartridges is alerted to a user. At S406, the refilling of ink to the head tank is finished.

Figure 11:
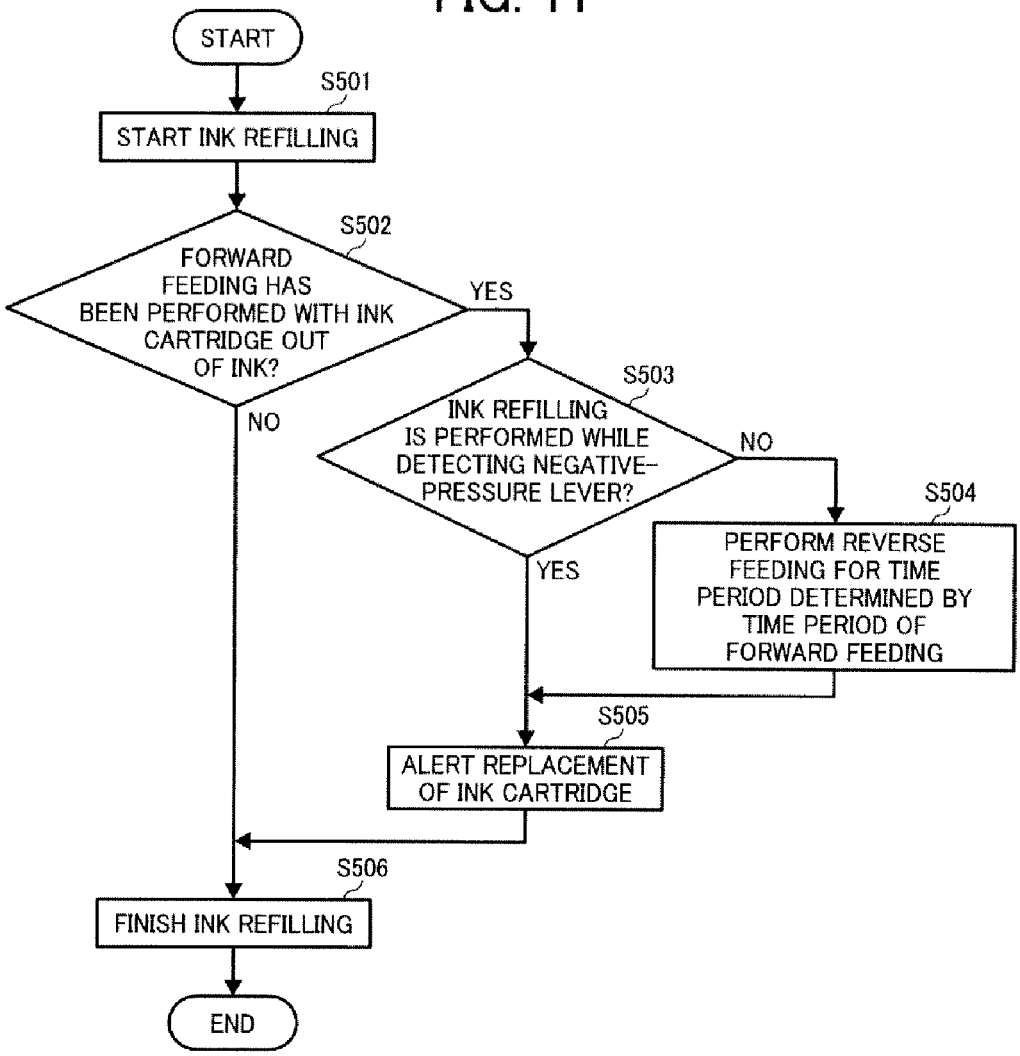
FIG. 11 is a flowchart illustrating further still another control process of liquid feeding in replacing ink cartridges.
Figure 12:
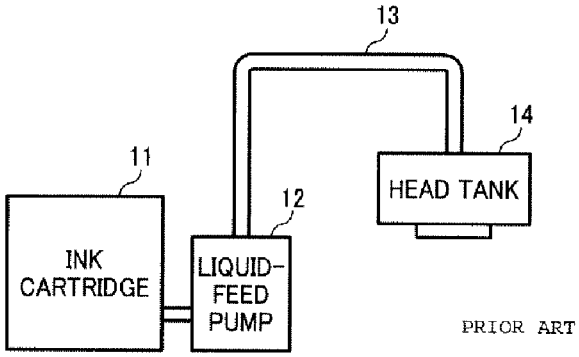
FIG. 12 is a schematic view illustrating a configuration of an ink-supply tube system in a conventional inkjet recording apparatus.
Figure 13:
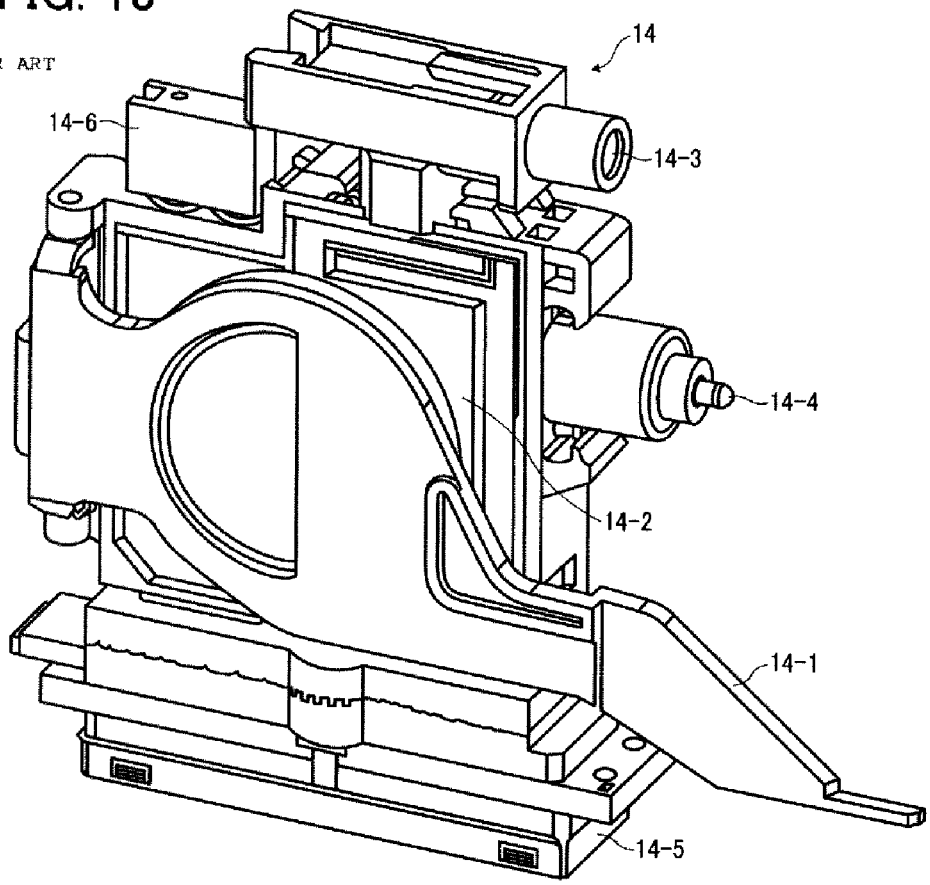
FIG. 13 PRIOR ART
FIG. 13 is a perspective view illustrating a configuration of a head tank used in the conventional inkjet recording apparatus.
Figure 14:
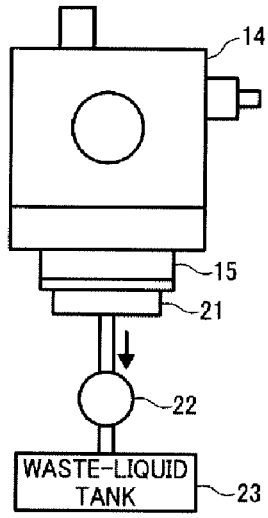
FIG. 14 PRIOR ART
FIG. 14 is a schematic cross-section view illustrating an example of negative-pressure creation in the head tank of the conventional inkjet recording apparatus.

FIG. 11 is a flowchart illustrating further still another control process of liquid feeding upon replacement of the ink cartridges. In FIG. 11, during execution of an ink supply operation for refilling ink to the head tank (S501), if the liquid-feed pump performs forward feeding with the ink cartridge out of ink ("YES" at S502) and ink is supplied while detecting a negative-pressure lever mounted on the head tank ("YES" at S503), at S505 replacement of the ink cartridges is alerted to a user without performing reverse feeding of the liquid-feed pump. By contrast, if ink is supplied without detecting the negative-pressure lever mounted on the head tank ("NO" at S503), at S504 the liquid-feed pump performs reverse feeding for a time period determined by a time period for which the liquid-feed pump has been performed the forward feeding. At S505, replacement of the ink cartridges is alerted to a user. At S506, the refilling of ink to the head tank is finished.

Here, a description is given of the time period for which the liquid-feed pump performs reverse feeding.

Although the execution time of reverse feeding varies depending on the viscosity of ink or elapsed time, if the maximum value of the amount of air introduced by idling of the liquid-feed pump is, for example, 0.4 cc, after idling of the liquid-feed pump, at least 0.4 cc of air should be returned toward the ink cartridge to release the negative pressure of the ink cartridge. In such a case, assuming that the actual value of the liquid feed amount of the liquid-feed pump is, e.g., 0.3 to 0.6 cc/sec, if ink has been fed at a lowest liquid-feed speed by forward feeding for eight seconds while detecting the negative-pressure lever, the execution time of reverse feeding by the liquid-feed pump is set to 1.3 seconds.

Thus, performing any of the control methods illustrated in FIGS. 8 to 11 of liquid feeding upon replacement of the ink cartridges prevents a strong negative pressure from occurring in the liquid feed passage by continuing rotation of the liquid-feed pump with the ink cartridge out of ink. As a result, mixing of air bubbles into the liquid feed passage upon replacement of the ink cartridges is prevented, thus preventing failures such as non-ejection of ink from a portion of nozzles or damage of the recording head.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. An inkjet recording apparatus comprising:

a droplet ejection head having a plurality of nozzles for ejecting ink;

a head tank mounted on the droplet ejection head, the head tank temporarily storing a certain amount of ink, the head tank creating negative pressure in the droplet ejection head;

a tube connected to the head tank;

an ink cartridge connected via the tube to the head tank, the ink cartridge storing ink; and a liquid-feed pump disposed at the tube between the ink cartridge and the head tank to feed ink in forward feeding from the ink cartridge to the head tank through the tube, the liquid-feed pump operable in reverse to feed ink in reverse feeding from the head tank through the tube to the ink cartridge and create negative pressure in the head tank, wherein the head tank including an air release valve, and when creating negative pressure, the head tank is opened to atmosphere via the air release valve and ink is fed in the forward feeding from the ink cartridge to the head tank, and then the air release valve is closed and ink is fed in the reverse feeding from the head tank to the ink cartridge to create the negative pressure in the head tank, and wherein ink passes same route in the forward feeding as that in the reverse feeding.

2. The inkjet recording apparatus according to claim 1, wherein the forward feeding is performed to feed ink from the ink cartridge to the head tank, and the reverse feeding is performed to feed ink from the head tank to the ink cartridge, and wherein, upon replacement of the ink cartridge, the liquid-feed pump operates in reverse in the reverse feeding to return ink from the head tank to the ink cartridge.

3. The inkjet recording apparatus according to claim 1, wherein the forward feeding is performed to feed ink from the ink cartridge to the head tank, and the reverse feeding is performed to feed ink from the head tank to the ink cartridge, and wherein, after the liquid-feed pump feeds ink to the head tank with the ink cartridge out of ink, the liquid-feed pump operates in reverse in the reverse feeding to return ink from the head tank to the ink cartridge.

4. The inkjet recording apparatus according to claim 1, wherein the forward feeding is performed to feed ink from the ink cartridge to the head tank, and the reverse feeding is performed to feed ink from the head tank to the ink cartridge, and wherein a time period for which the liquid-feed pump operates in reverse in the reverse feeding is determined by a time period for which the liquid-feed pump feeds ink in the forward feeding to the head tank with the ink cartridge out of ink.

5. The inkjet recording apparatus according to claim 1, further comprising:

a detector mounted on the head tank, the detector detecting ink and air in the head tank; and a controller mounted on the head tank and communicatively connected to the detector, the controller controlling the detector in accordance with a signal outputted from the detector, wherein the forward feeding is performed to feed ink from the ink cartridge to the head tank, and the reverse feeding is performed to feed ink from the head tank to the ink cartridge, and wherein, when the liquid-feed pump feeds ink in the forward feeding to the head tank with the ink cartridge out of ink while the detector is used, the liquid-feed pump is controlled so as not to operate in reverse.

6. The inkjet recording apparatus according to claim 1, further comprising a negative-pressure lever that shifts in response to the amount of ink in the head tank and detects a state of the negative pressure in the head tank, the negative-pressure lever mounting on the head tank, wherein the forward feeding is performed to feed ink from the ink cartridge to the head tank, and the reverse feeding is performed to feed ink from the head tank to the ink cartridge, and wherein, after the liquid-feed pump feeds ink in the forward feeding to the head tank with the ink cartridge out of ink during detection of the negative-pressure lever, the liquid-feed pump operates in reverse to return ink in the reverse feeding from the head tank to the ink cartridge for a time period determined by a time period for which the liquid-feed pump has been fed ink in the forward feeding to the head tank with the ink cartridge out of ink.

7. The inkjet recording apparatus according to claim 1, wherein the liquid-feed pump is a tube pump.

8. The inkjet recording apparatus according to claim 1, wherein the forward feeding is performed to feed ink from the ink cartridge to the head tank, and the reverse feeding is performed to feed ink from the head tank to the ink cartridge, and wherein the liquid-feed pump, after feeding ink in the forward feeding to the head tank, operates in reverse to create negative pressure in the head tank.

9. The inkjet recording apparatus according to claim 8, wherein, in creating negative pressure, an amount of ink fed by the liquid-feed pump in the forward feeding to the head tank is greater than an amount of ink fed by operation in reverse of the liquid-feed pump in the reverse feeding to feed ink from the head tank to the ink cartridge.

10. The inkjet recording apparatus according to claim 1, wherein a liquid-feed amount of the forward feeding is set to be equal to or greater than a liquid-feed amount of the reverse feeding.

* * * * *